US008646514B2

(12) United States Patent
Ni

(10) Patent No.: US 8,646,514 B2
(45) Date of Patent: Feb. 11, 2014

(54) FRONT END WATER BOX WITH ON-LINE RUBBER BALL CLEANING FUNCTION IN THE TUBULAR CONDENSER OF A WATER COOLED CHILLER

(76) Inventor: Yonggang Ni, Shenzhen (CN)

( * ) Notice: Subject to any disclaimer, the term of this patent is extended or adjusted under 35 U.S.C. 154(b) by 753 days.

(21) Appl. No.: 12/935,815

(22) PCT Filed: Sep. 1, 2009

(86) PCT No.: PCT/CN2009/073655

§ 371 (c)(1),
(2), (4) Date: Sep. 30, 2010

(87) PCT Pub. No.: WO2011/026263

PCT Pub. Date: Mar. 10, 2011

(65) Prior Publication Data

US 2011/0168353 A1 Jul. 14, 2011

(51) Int. Cl.
*F28G 1/12* (2006.01)

(52) U.S. Cl.
USPC ..... 165/95; 15/3.51; 15/3.52; 15/104.05; 15/104.061; 15/104.062

(58) Field of Classification Search
USPC ..... 165/95, 119; 15/104.05, 15/104.061–104.063, 3.5, 3.51, 3.52
See application file for complete search history.

(56) References Cited

U.S. PATENT DOCUMENTS 4,556,102 A * 12/1985 Bochinski et al. ..... 165/95
5,176,204 A 1/1993 Ben-dosa
5,251,690 A 10/1993 Otake et al.

FOREIGN PATENT DOCUMENTS

CN 201016636 2/2008
CN 201129969 10/2008

(Continued)

OTHER PUBLICATIONS

Drawing (Figure 1) of DE2818033; K. Eimer, D. Patzig, H. Thal; published on Aug. 9, 1979.*

(Continued)

*Primary Examiner* — John Ford
*Assistant Examiner* — Orlando E Aviles Bosques
(74) *Attorney, Agent, or Firm* — Hamre, Schumann, Mueller & Larson, P.C.

(57) ABSTRACT

A front end water box with an on-line rubber ball cleaning function in a tubular condenser of a water cooled chiller is provided. A front end water box and an automatic on-line rubber ball cleaning device are integrated. Besides the structure of a normal front end water box, a ball receiving device, a rubber ball collection cavity, a ball sending device, a division drainage device, a ball sending division separator, a ball observer, an automatic rubber ball receiving-and-sending control valve, an automatic terminal temperature difference (TTD) monitoring and recording device, and an automatic rubber ball cleaning controller are further included. Therefore, division cleaning, on-line observation, and rubber ball replacement are automatically realized, the operation TTD of the chiller is automatically displayed and recorded, and a function of manually adjusting the cleaning frequency, period, and start and stop is achieved, so as to ensure that the TTD increase of the chiller does not exceed 0.3° C., so that the chiller is always in a high efficiency operation status. Also, the front end water box has a simple and compact structure, realizes receiving, sending, and cleaning processes of the rubber balls completely depending on hydraulic principles and a pressure difference between inlet and outlet cooling water, needs no external power, is energy saving and environmentally friendly, and is able to be delivered with a water cooled chiller.

10 Claims, 16 Drawing Sheets

(56) References Cited

FOREIGN PATENT DOCUMENTS

| | | |
|---|---|---|
| CN | 101451297 | 6/2009 |
| CN | 101691980 | 4/2010 |
| JP | 20063007 | 1/2006 |

OTHER PUBLICATIONS

Drawing (Figure 1) of JP05-280890; K. Nakajima, O. Oishi, K. Saito; published on Oct. 29, 1993.*

* cited by examiner

--Prior Art--

B-B

A-A

FRONT END WATER BOX WITH ON-LINE RUBBER BALL CLEANING FUNCTION IN THE TUBULAR CONDENSER OF A WATER COOLED CHILLER

BACKGROUND OF THE INVENTION

1. Field of Invention

The present invention relates to a front end water box with an automatic on-line rubber ball cleaning function in a condenser, which is particularly applicable to a tubular condenser of a 2-pass water cooled chiller, and at the same time applicable to a 2-pass tubular flooded evaporator thereof as well as a 2-pass water cooled tubular heat exchanger with cooling water through tube pass at a temperature not exceeding 80° C.

2. Related Art

Existing automatic on-line rubber ball cleaning devices in a condenser of a water cooled chiller are categorized into the following two types. One type is an independent cleaning system device, which is connected to the inlet and outlet of the condenser through pipelines. A ball sending device sends rubber balls into the inlet pipeline of cooling water. The rubber balls flow into the condenser with the cooling water, flow out of the outlet of cooling water after cleaning, flow into a ball capturing device, and then enter the ball sending device again. Such a cleaning device has the following defects: 1. the cleaning device needs on-site installation and construction, which requires a high work load, so that the cleaning device is unable to be delivered with the chiller; 2. as it is required to send balls at a high speed, great dynamic power is configured for sending the balls, for example, a water pump, an air compressor, or a water flow with a large pressure difference is needed. The other type is to set four-way flow reversing devices at the inlet and outlet of the condenser, and cleaning elements are installed inside the heat exchange tube of the condenser. Inner walls of the heat exchange tubes are cleaned through the reciprocating movement of the cleaning elements as the flow direction changes. Referring to Chinese Patent Publication No. CN101451297A, such an automatic cleaning device through flow direction changes has the following two defects: 1. during the direction change, high temperature water enters the condenser, instantaneously a great change occurs to the condensing temperature of refrigerant inside the condenser of a chiller, and instantaneous efficiency of the chiller is greatly fluctuated, posing great impact to the operation of the chiller and even causing side effects such as surges in the chiller; 2, as the water flow speed in each heat exchange tube is different due to distribution of the water flow field on the tube plate of the condenser, after operation for a period of time, some cleaning elements are stuck in blocking elements and cannot make reciprocating cleaning movement.

SUMMARY OF THE INVENTION

The independent cleaning device in the prior art needs on-site installation and a high power ball sending device, and side effects are caused by the four-way flow reversing device. Accordingly, the present invention provides a front end water box with an automatic on-line rubber ball cleaning function in a condenser having a compact and simple structure.

In order to solve the technical problems, the present invention provides the following technical solution. A front end water box with an on-line rubber ball cleaning function in a tubular condenser of a water cooled chiller is provided. The front end water box is divided from the middle into an upper water box and a lower water box by a divider. The upper water box is in communication with the outlet of a condenser heat exchange tube. The upper water box is in communication with a cooling water outlet pipe. The lower water box is in communication with the inlet of the condenser heat exchange tube. The lower water box is in communication with a cooling water inlet pipe. An automatic on-line rubber ball cleaning device is disposed inside the front end water box. The automatic on-line rubber ball cleaning device and the front end water box are integrally disposed. The automatic on-line rubber ball cleaning device includes a ball receiving device, a rubber ball collection cavity, a ball sending device, an automatic rubber ball receiving-and-sending control valve, and an automatic rubber ball cleaning controller. The ball receiving device is disposed inside the upper water box and used for receiving rubber balls. The ball receiving device is in communication with the rubber ball collection cavity. The rubber ball collection cavity is in communication with the ball sending device. The ball sending device is in communication with the lower water box and used for sending rubber balls into the lower water box. The water inlet end of the automatic rubber ball receiving-and-sending control valve is in communication with the cooling water inlet pipe. The water outlet end of the automatic rubber ball receiving-and-sending control valve is in communication with the cooling water outlet pipe. The connecting end of the automatic rubber ball receiving-and-sending control valve is in communication with the rubber ball collection cavity. The automatic rubber ball receiving-and-sending control valve comprises a valve and an automatic valve controller.

In order to solve the technical problems, the technical solutions provided in the present invention further include the following:

The ball receiving device includes a bottom check valve and one or more ball receiving filter screens disposed inside the upper water box. The ball receiving filter screen is in a special horn shape. The opening of the horn-shaped ball receiving filter screen faces the outlet of the condenser heat exchange tube. Openings of the ball receiving filter screens are joined together to match the shape of the cross-section of the upper water box. Tail ends of the ball receiving filter screens are in communication with the rubber ball collection cavity through a tube segment. The tube segment is located at an end of the rubber ball collection cavity and is fixedly installed with the bottom check valve.

One to five ball receiving filter screens are disposed.

The outlet of the rubber ball collection cavity is in communication with the lower water box, and a ball sending check valve is disposed between the rubber ball collection cavity and the lower water box.

One or more rubber ball division separators are fixedly installed inside the lower water box, so as to separate the lower water box into two or more ball sending regions. A ball sending check valve is installed between the rubber ball collection cavity and each ball sending region. The direction of the rubber ball division separator is the downstream direction of the cooling water inside the lower water box.

A vertical rubber ball division separator is fixedly installed inside the lower water box and separates the lower water box into a left ball sending region and a right ball sending region. Left and right sides of the rubber ball collection cavity are respectively in communication with the cooling water outlet pipe through a first division drainage tube and a second division drainage tube. One end of the first division drainage tube extends into the rubber ball collection cavity. A tapered filter screen is fixedly installed at that end inside the rubber ball collection cavity. The other end of the first division drainage tube is in communication with the cooling water outlet pipe. A first drainage control electromagnetic valve is installed in the middle of the first division drainage tube. One end of the second division drainage tube extends into the rubber ball collection cavity. A tapered filter screen is fixedly installed at that end inside the rubber ball collection cavity. The other end of the second division drainage tube is in communication with the cooling water outlet pipe. A second drainage control electromagnetic valve is installed in the middle of the second division drainage tube.

Said rubber ball division separator is made of a corrosion resistant material, and holes smaller than the diameter of the rubber balls are punched on the rubber ball division separator.

The rubber ball collection cavity is fixedly connected to the top of the front end water box. A duckbill-shaped cavity is provided at a connecting position of the rubber ball collection cavity and the front end top of the front end water box. A circular hole is opened at the front end top. The duckbill-shaped cavity is in communication with the connecting end of the automatic rubber ball receiving-and-sending control valve at the circular hole at the front end top.

One or more circular holes are punched through the side wall of the rubber ball collection cavity. A tapered filter screen is installed at the end of each circular hole inside the rubber ball collection cavity, and each tapered filter screen urges a bottom check valve. The other end of the circular hole is in communication with the duckbill-shaped cavity.

A ball observer is fixedly installed at an outer side of the water box. A transparent ball observation sight glass is disposed at a central position of the ball observer. The inlet of the ball observer is in communication with the rubber ball collection cavity through a tube segment, on which a manual ball valve is disposed. The outlet of the ball observer is in communication with the cooling water inlet pipe through a tube segment. A manual high pressure ball valve is disposed between the outlet of the ball observer and the cooling water inlet pipe. A drain valve is disposed at the ball observer bottom.

A control box is fixedly installed at an outer side of the front end water box. An automatic rubber ball cleaning controller is installed inside the control box. The automatic rubber ball cleaning controller includes a programmable controller, a display, and input buttons. The display and input buttons are respectively connected to data ports of the programmable controller.

A temperature display and a record module are further disposed inside the control box. Two temperature sensors are connected to the temperature display and the record module. One temperature sensor is disposed at a cooling water outlet pipe and the other temperature sensor is disposed on the condenser body. Alternatively, the temperature display and the record module are respectively connected to a temperature sensor and a pressure sensor. The temperature sensor is disposed at the cooling water outlet pipe and the pressure sensor is disposed on the condenser body.

The beneficial effects of the present invention are as follow. In the present invention, the front end water box in the tubular condenser of the existing 2-pass water cooled chiller has an automatic on-line rubber ball cleaning function. The water box automatically realizes the cleaning or the division cleaning process, on-line observation, and rubber ball replacement, automatic displays and records of the terminal temperature difference (TTD) for the operation of the chiller, and has functions of manually adjusting the cleaning frequency, period, and start-and-stop, so as to ensure that the TTD increase of the chiller does not exceed 0.3° C., so that the water box is always kept in a high-efficiency operation status. The present invention has a simple and compact structure, and the rubber balls are received and sent completely by the hydraulic principles and pressure difference between inlet and outlet cooling water without requirement for external dynamic sources, so the present invention is energy saving, environmentally friendly, and can be delivered with the water cooled chiller, and also can be delivered with the 2-pass water cooled tubular heat exchanger with a tubular flooded evaporator at a temperature not exceeding 80° C., so that the present invention is a high-efficiency energy saving new product.

DETAILED DESCRIPTION OF THE INVENTION

A preferred embodiment of the present invention is described in the following, and all other embodiments having the same or similar principles and basic structures as this embodiment should fall within the protection scope of the present invention.

Figure 1:
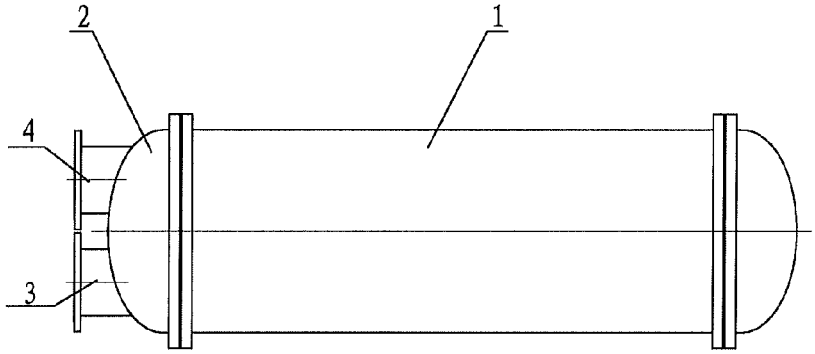
FIG. 1 is a schematic view of a tubular condenser and a front end water box in a 2-pass water cooled chiller in the prior art.
Figure 2:
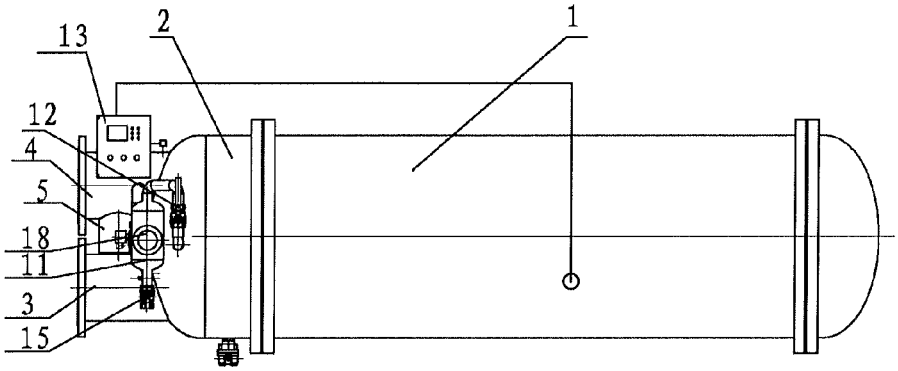
FIG. 2 is a schematic structural view of a front end water box and a condenser according to the present invention.
Figure 5:
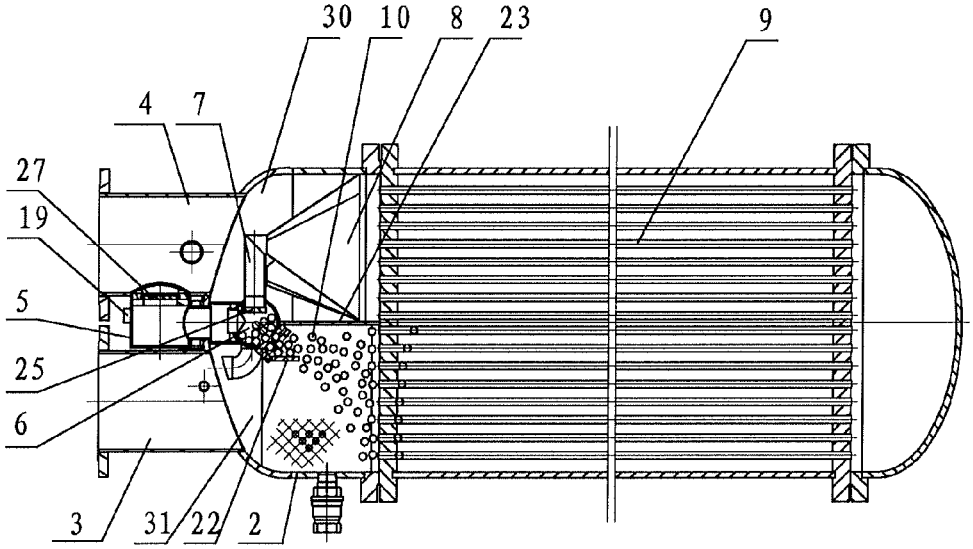
FIG. 5 is a schematic structural inner view (in a ball sending status) according to the present invention.
Figure 6:
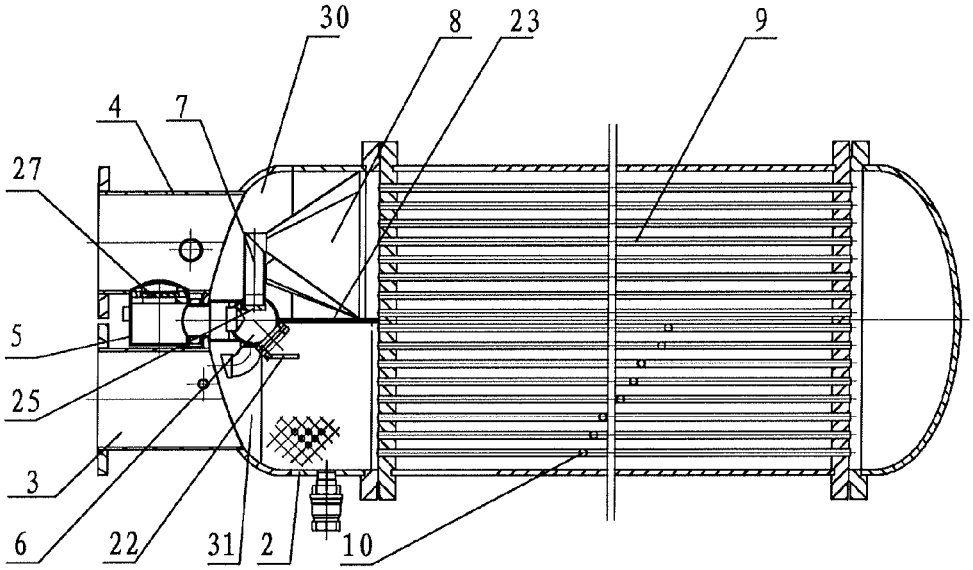
FIG. 6 is a schematic structural inner view (in a cleaning status) according to the present invention.
Figure 7:
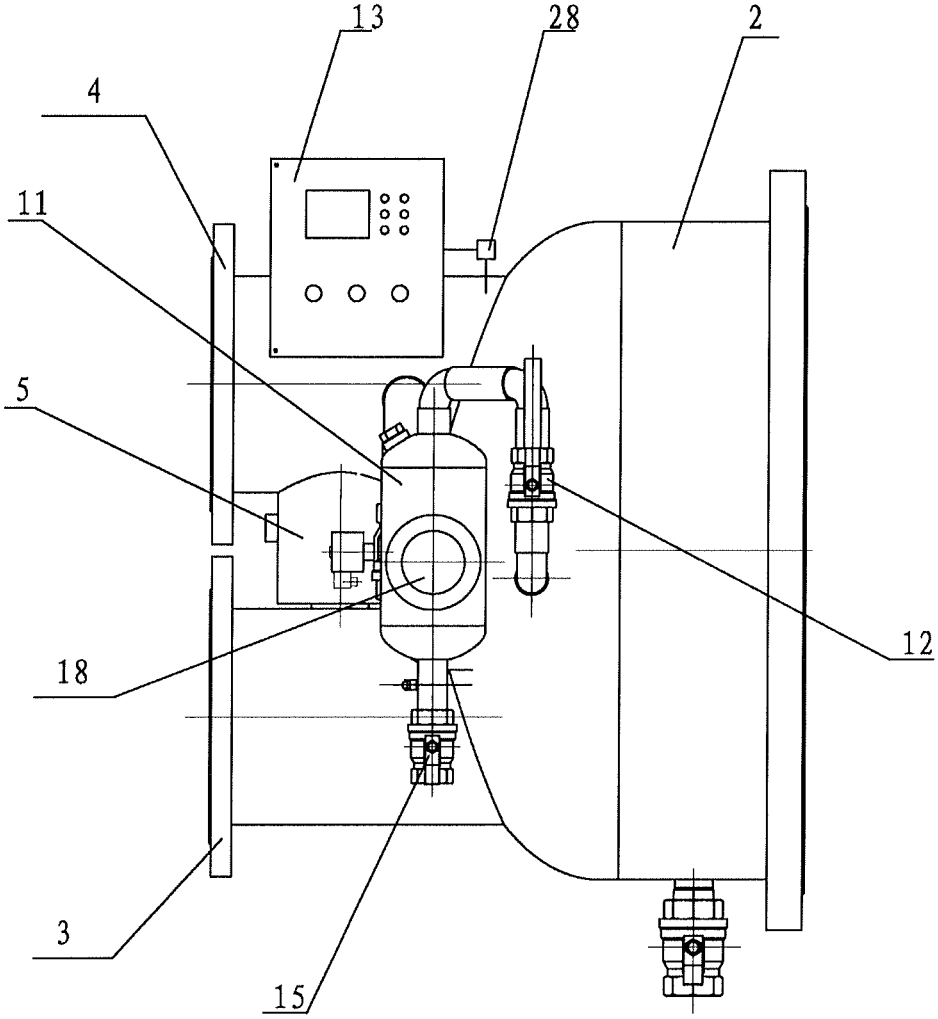
FIG. 7 is a schematic structural outer view according to the present invention.
Figure 8:
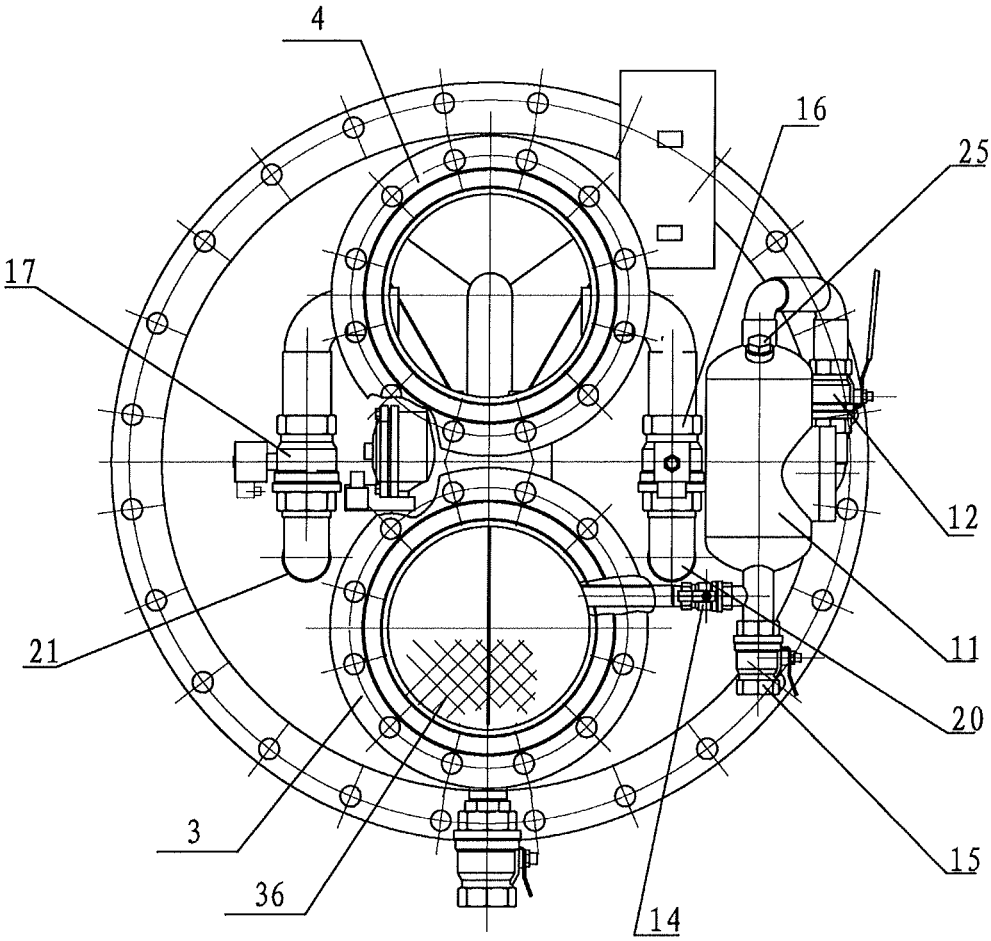
FIG. 8 is a schematic structural side view according to the present invention.
Figure 9:
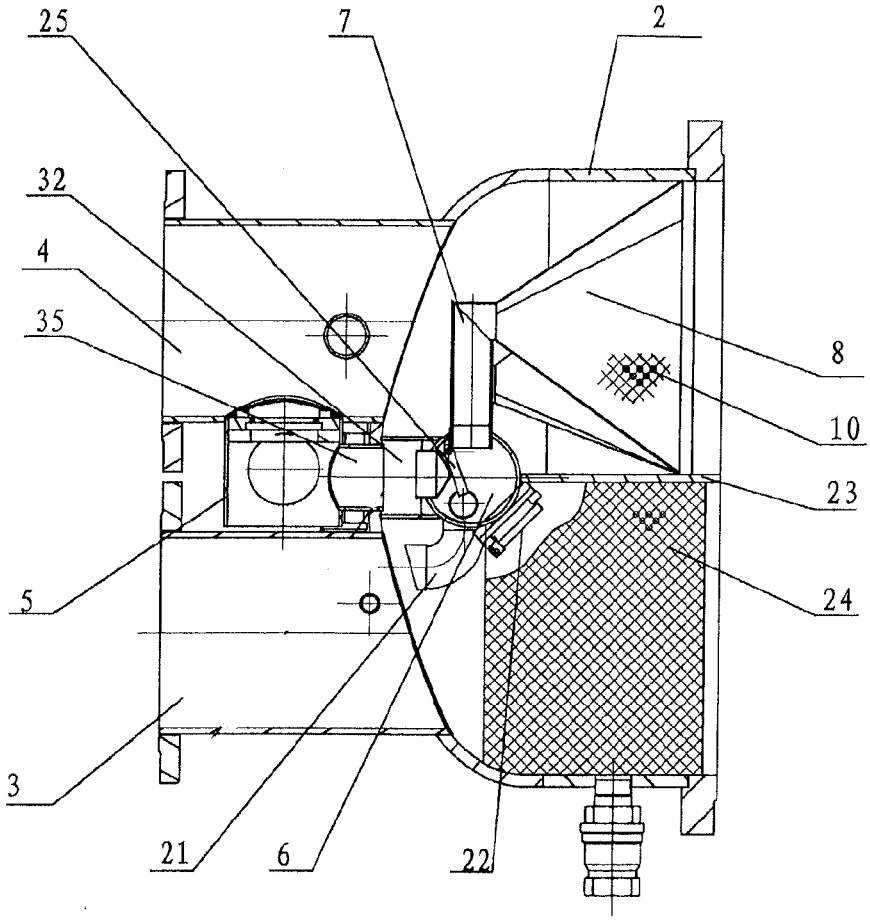
FIG. 9 is a schematic structural inner view according to the present invention.
Figure 10:
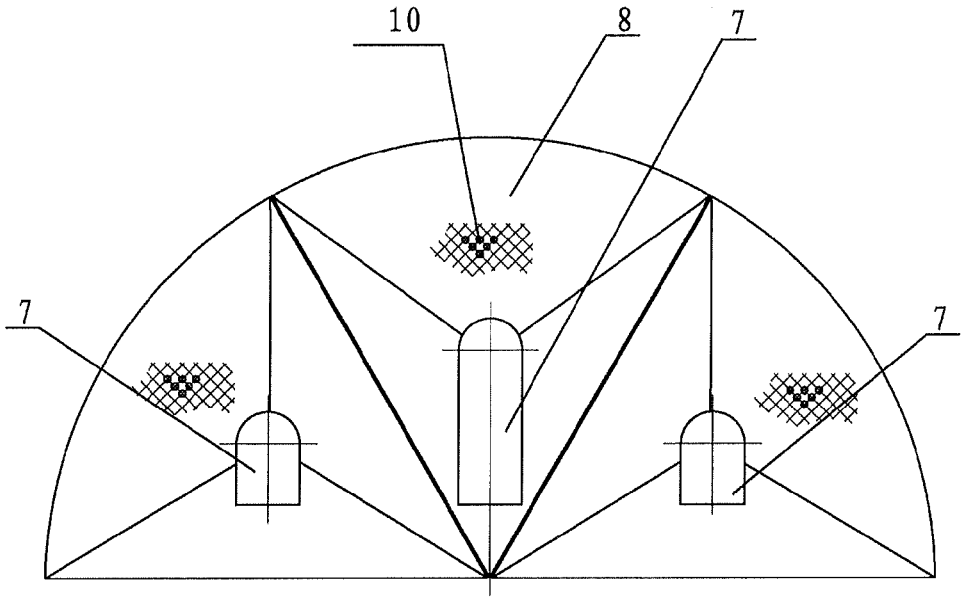
FIG. 10 is a schematic structural front view of a ball receiving filter screen inside the upper water box of the front end water box according to the present invention.
Figure 11:
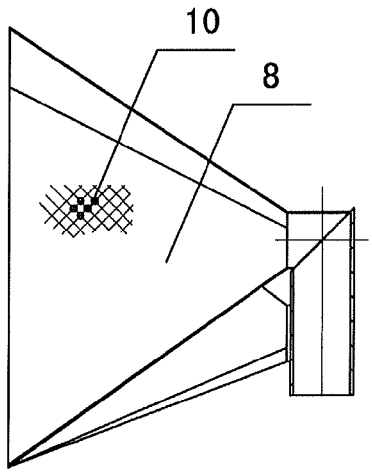
FIG. 11 is a schematic structural side view of a ball receiving filter screen inside the upper water box of the front end water box according to the present invention.
Figure 12:
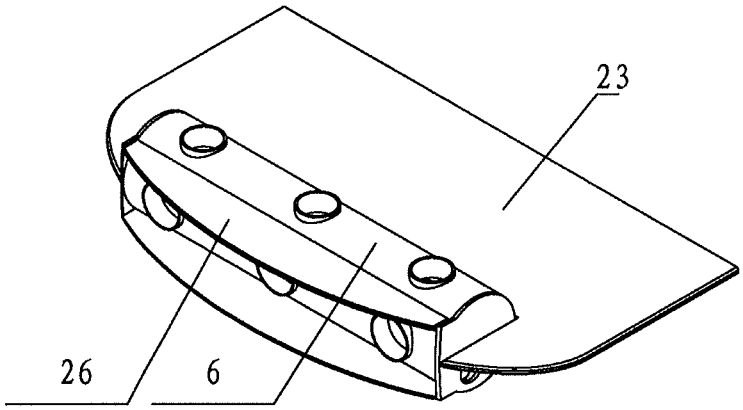
FIG. 12 is a three-dimensional schematic structural view of a ball receiving cavity in the middle according to the present invention.
Figure 13:
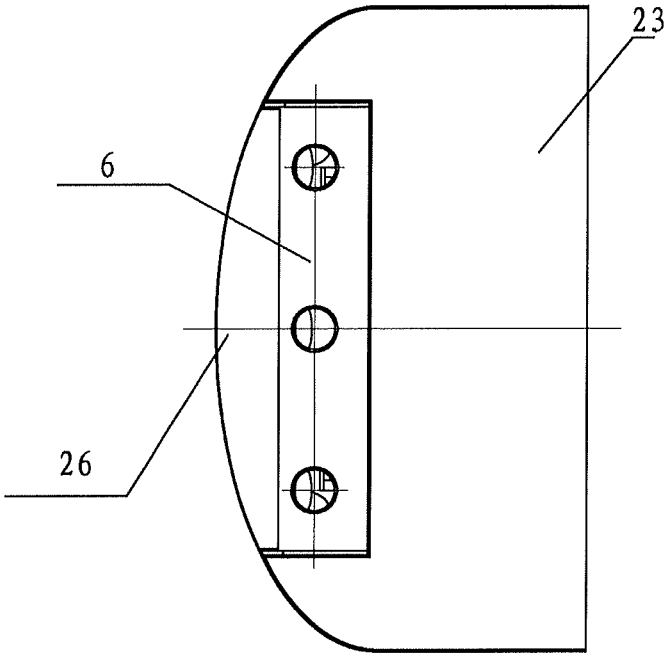
FIG. 13 is a schematic structural front view of a ball receiving cavity in the middle according to the present invention.
Figure 14:
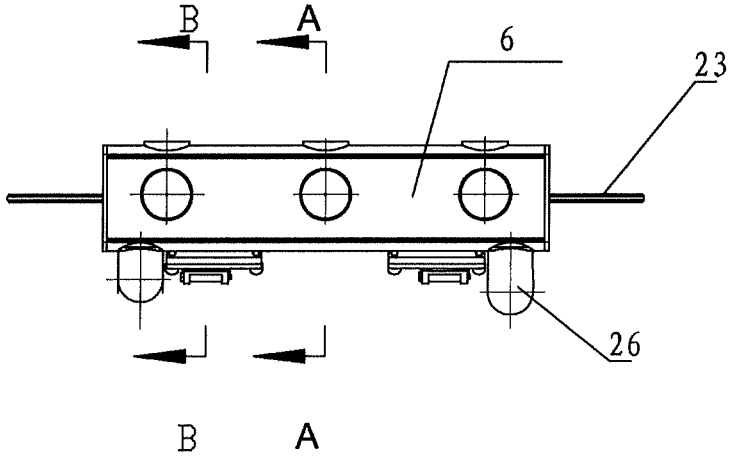
FIG. 14 is a schematic structural side view of a ball receiving cavity in the middle according to the present invention.
Figure 15:
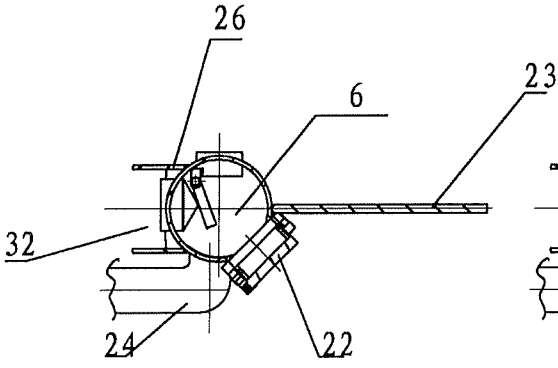
FIG. 15 is a schematic structural sectional view along B-B in FIG. 14.
Figure 16:
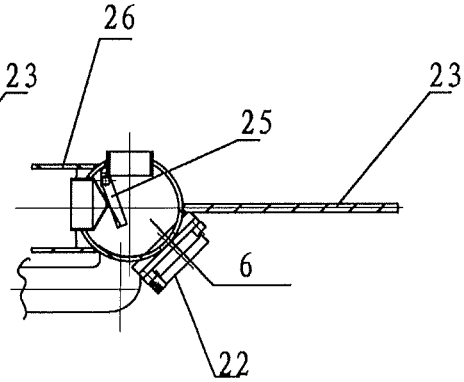
FIG. 16 is a schematic structural sectional view along A-A in FIG. 14.
Figure 17:
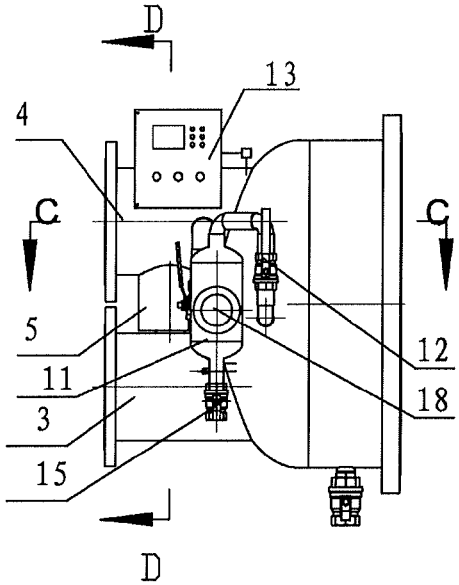
FIG. 17 is a schematic structural outer view according to the present invention.
Figure 18:
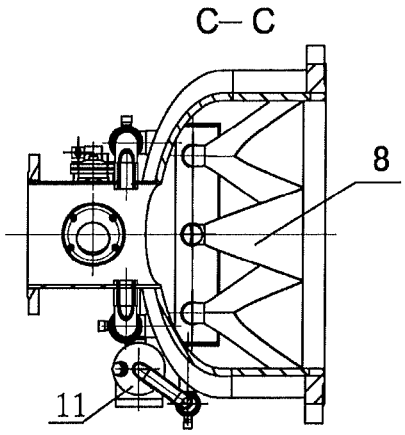
FIG. 18 is a schematic structural sectional view along C-C in FIG. 17.
Figure 19:
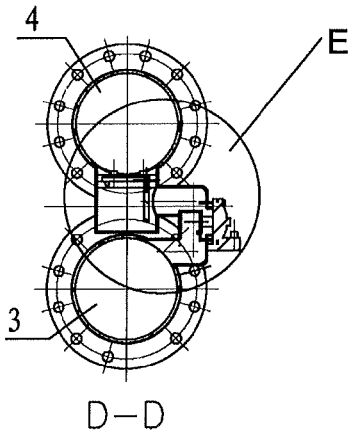
FIG. 19 is a schematic structural view of an automatic rubber ball receiving-and-sending control valve according to the present invention (a schematic structural sectional view along D-D in FIG. 17)
Figure 20:
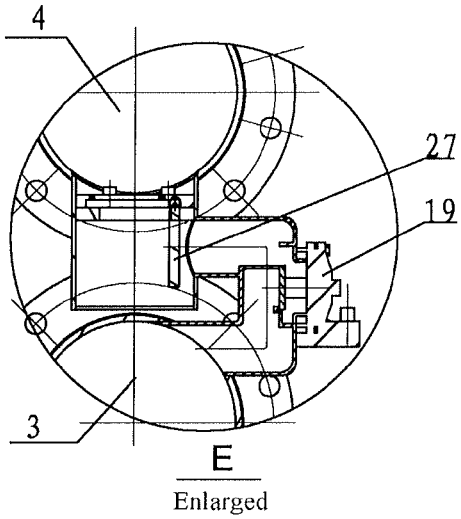
FIG. 20 is an enlarged structural view of the portion E in FIG. 19.
Figure 21:
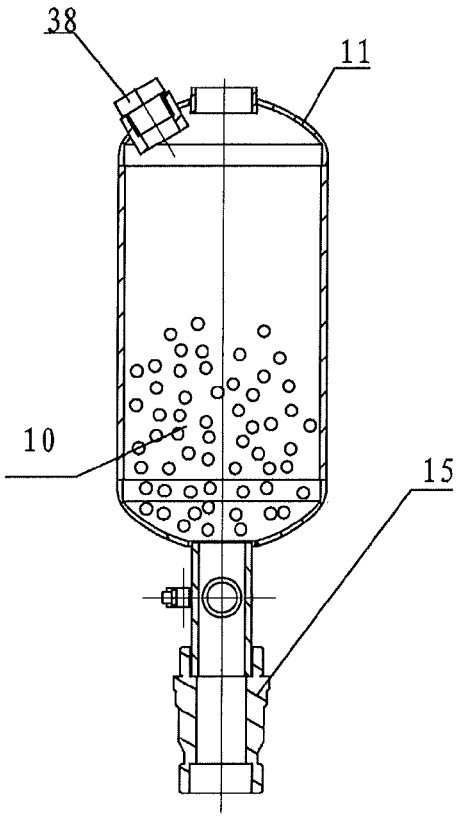
FIG. 21 is a schematic structural front view of a ball observer according to the present invention.
Figure 22:
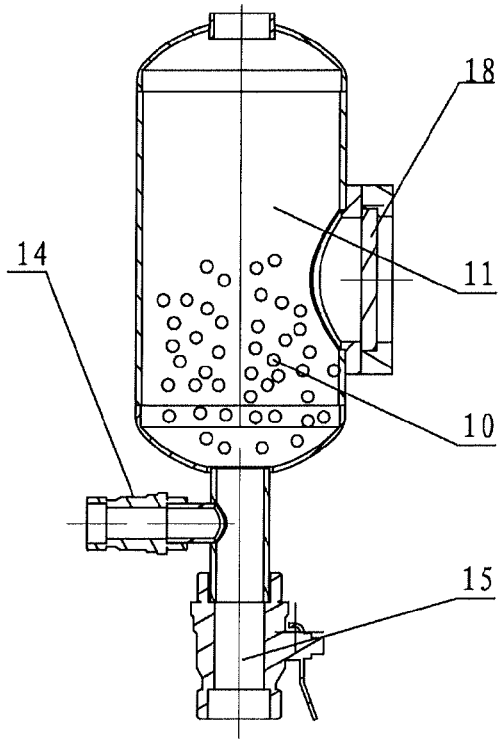
FIG. 22 is a schematic structural side view of a ball observer according to the present invention.
Figure 23:
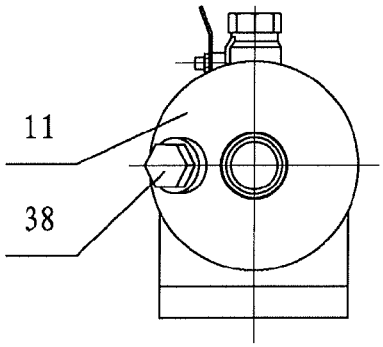
FIG. 23 is a schematic structural top view of a ball observer according to the present invention.
Figure 24:
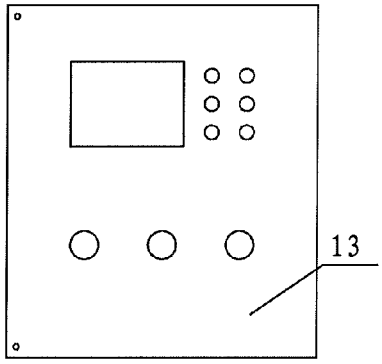
FIG. 24 is a schematic structural front view of an automatic rubber ball cleaning controller according to the present invention.
Figure 25:
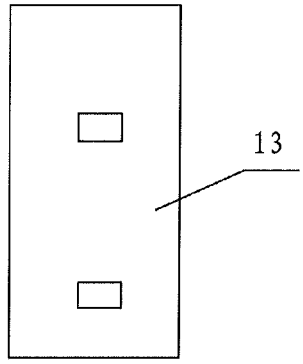
FIG. 25 is a schematic structural side view of an automatic rubber ball cleaning controller according to the present invention.
Figure 26:
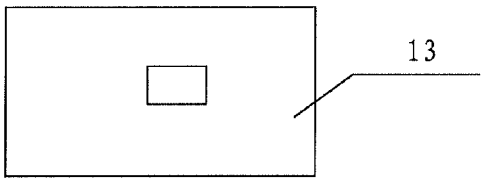
FIG. 26 is a schematic structural top view of an automatic rubber ball cleaning controller according to the present invention.
Figure 27:
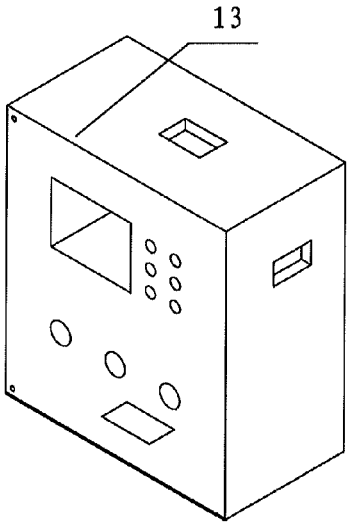
FIG. 27 is the first three-dimensional schematic structural view of an automatic rubber ball cleaning controller according to the present invention.
Figure 28:
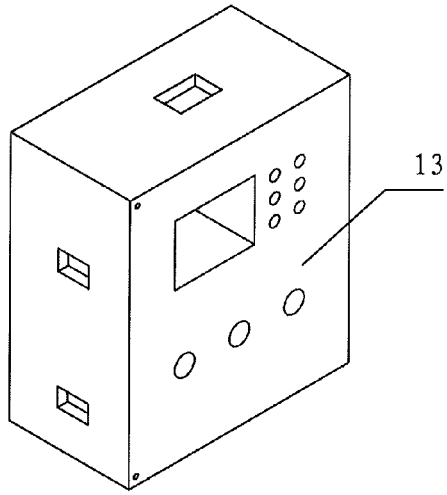
FIG. 28 is the second three-dimensional schematic structural view of an automatic rubber ball cleaning controller according to the present invention.
Figure 29:
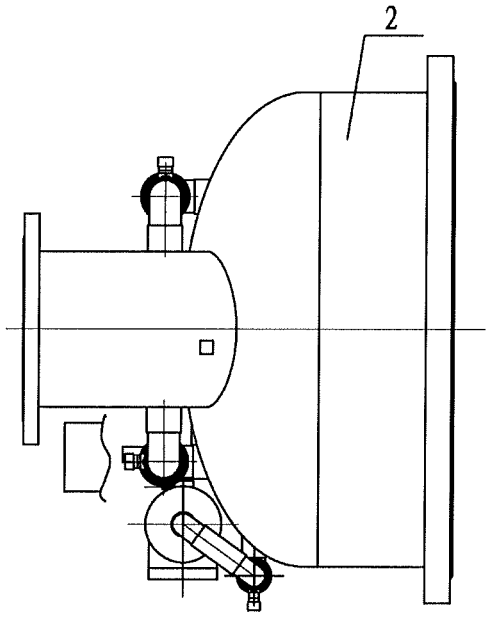
FIG. 29 is a schematic structural top view of a rubber ball division drainage tube according to the present invention.
Figure 30:
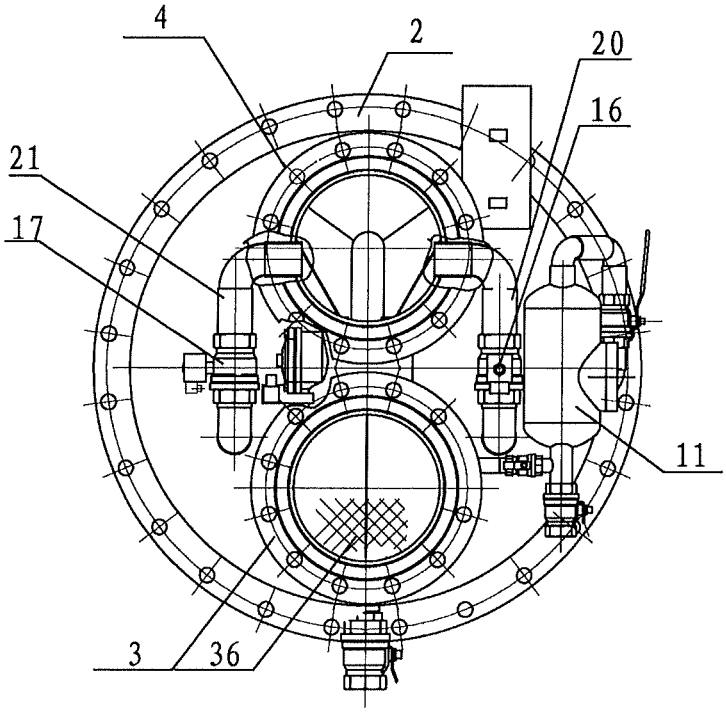
FIG. 30 is a schematic structural side view of a rubber ball division drainage tube according to the present invention.
Figure 31:
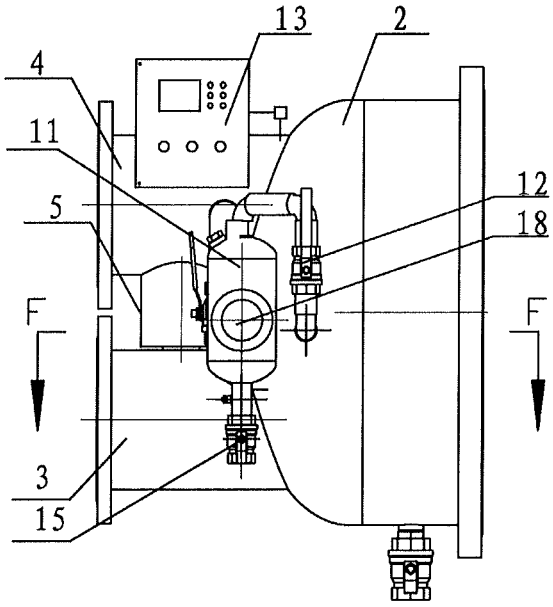
FIG. 31 is a schematic structural outer view according to the present invention.
Figure 32:
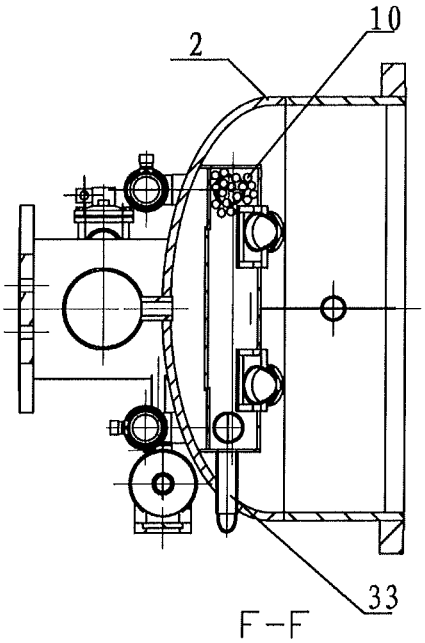
FIG. 32 is a front view of a rubber ball division drainage tube (a schematic structural sectional view along F-F in FIG. 31)
Figure 33:
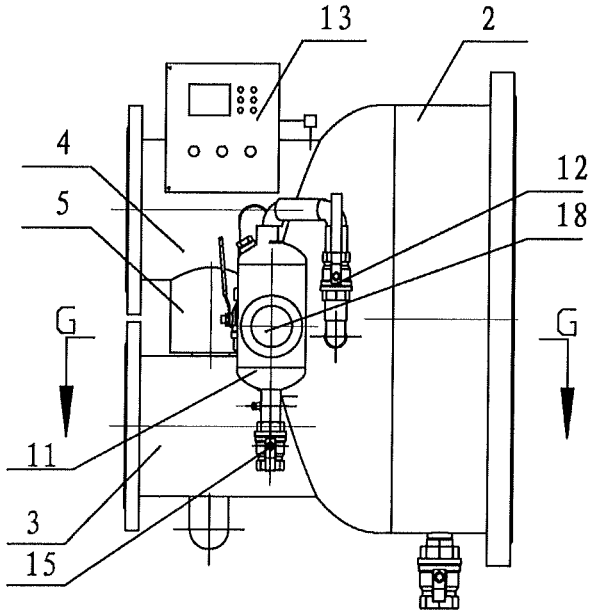
FIG. 33 is a schematic structural outer view according to the present invention.
Figure 34:
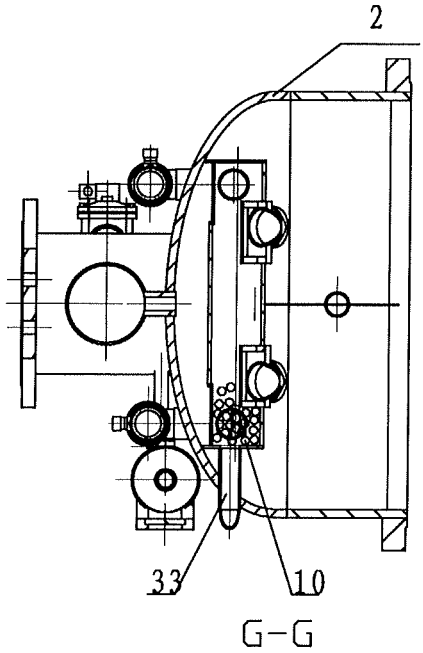
FIG. 34 is a schematic view of a rubber ball division separator (a schematic structural sectional view along G-G in FIG. 33)
Figure 35:
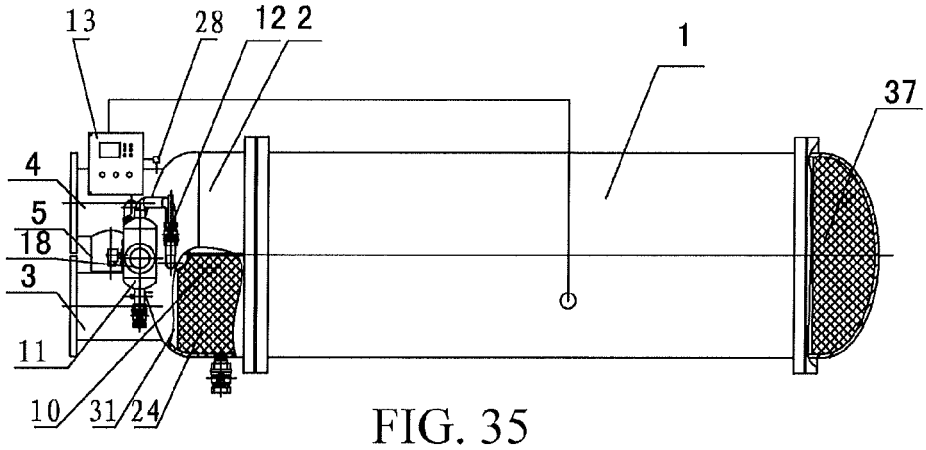
FIG. 35 is a schematic structural view of a TTD monitoring and recording system (with a partial section) according to the present invention.

Referring to FIGS. 2, 7, and 8, the present invention is a front end water box in a tubular condenser of a 2-pass water cooled chiller with an automatic on-line rubber ball cleaning function, which is used in combination with the condenser body 1. Referring to FIGS. 3 to 6, the present invention is mainly a condenser front end water box fixedly joined with the condenser body 1, which mainly includes a water box 2 and an automatic on-line rubber ball cleaning device integrally disposed with the water box 2. A divider 23 is fixedly welded at a central position of the water box 2. The water box 2 is divided into upper and lower portions by the divider 23. The upper half portion is in communication with the outlet of the condenser heat exchange tube 9, which forms the upper water box 30. The upper water box 30 is in communication with the cooling water outlet pipe 4. The lower half portion is in communication with the inlet of the condenser heat exchange tube 9, which forms the lower water box 31. The lower water box 31 is in communication with the cooling water inlet pipe 3. A ball strainer 36 is fixedly installed at the outlet of the cooling water inlet pipe 3. The mesh size of the ball strainer 36 is smaller than the diameter of rubber balls 10, so as to prevent the rubber balls 10 from flowing back into the cooling water inlet pipe 3. The automatic on-line rubber ball cleaning device mainly includes a ball receiving device and a rubber ball collection cavity 6. Referring to FIGS. 9, 10, and 11, in this embodiment, the ball receiving device includes a bottom check valve and one to five ball receiving filter screens 8. According to the diameter of the front end water box, specifically, according to the cross-sectional area of the upper water box 30, the ball receiving filter screens 8 may be divided into 1 to 5 screens. The ball receiving filter screen 8 is made by punching a stainless steel plate (or other corrosion resistant materials) and has a special horn shape (that is, the ball receiving filter screen 8 is filled with holes having a diameter of Φ6, so that water flows through the holes and flows into the cooling water outlet pipe 4, the diameter of the holes is set according to the size of the rubber balls, in which the diameter of the holes is smaller than the diameter of the rubber balls, so that the rubber balls 10 are kept by the ball receiving filter screen 8). The large end (that is, a horn-shaped opening) of the ball receiving filter screen 8 faces the tube array of the condenser (that is, the opening of the horn-shaped ball receiving filter screen 8 faces the outlet of the condenser heat exchange tube 9, and the openings of one or more ball receiving filter screens 8 are joined together to form a shape that just matches the shape of the cross section of the upper water box 30, so that the upper water box 30 can be completely blocked, so as to prevent the rubber balls 10 from flowing into the cooling water outlet pipe 4). The small end (that is, the tail end) of the ball receiving filter screen 8 and the ball receiving tube segment 7 form a 90° angle and are in communication with each other. The ball receiving tube segment 7 extends into the rubber ball collection cavity 6. A swing bottom check valve 25 is installed at the bottom of the ball receiving tube segment 7. When the rubber balls 10 enter the front end upper water box 30, the rubber balls 10 gather at the ball receiving tube segment 7 with the water flow and enter the rubber ball collection cavity 6 with the water flow. Referring to FIGS. 12 to 16, in this embodiment, the rubber ball collection cavity 6 is a steel pipe, which is integrally welded with the water box divider 23. The upper portion of the rubber ball collection cavity 6 is in communication with the ball receiving tube segment 7, and two ball sending check valves 22 are installed at the lower portion thereof. The two ball sending check valves 22 are respectively disposed at the left and right half regions of the lower water box 31 of the front end. When no division separator 24 is disposed, the rubber ball collection cavity 6 can also be in communication with the lower water box 31 through a ball sending check valve 22. A duckbill-shaped steel plate 26 is fixedly welded on the rubber ball collection cavity 6 in the direction away from the condenser. The duckbill-shaped steel plate 26 and the front end top are welded to form the duckbill-shaped rubber ball receiving-and-sending waterway 32. One to five circular holes are opened on the rubber ball collection cavity 6. The position of each circular hole corresponds to a swing bottom check valve 25 at the bottom of the ball receiving tube segment 7. A tapered filter screen is fixedly installed at the end of the circular hole inside the rubber ball collection cavity 6, so as to form a flow channel hole. The cone apex of the tapered filter screen urges the swing bottom check valve 25 at the bottom of the ball receiving tube segment 7. The end of the flow channel hole at the rubber ball collection cavity 6 is in communication with the duckbill-shaped rubber ball receiving-and-sending waterway 32. The duckbill-shaped rubber ball receiving-and-sending waterway 32 is in communication with the connecting end of the automatic rubber ball receiving-and-sending control valve 5 through a main waterway 35. Referring to FIGS. 17 to 20, the water outlet end of the automatic rubber ball receiving-and-sending control valve 5 is in communication with the cooling water outlet pipe 4. A swing ball receiving main check valve 27 is disposed at the connecting position. The ball receiving main check valve 27 is turned on in a ball receiving status and turned off in a ball sending status. The water inlet end of the automatic rubber ball receiving-and-sending control valve 5 is in communication with the cooling water inlet pipe 3. A ball sending control valve 19 is disposed on the channel between the automatic rubber ball receiving-and-sending control valve 5 and the cooling water inlet pipe 3. The ball sending control valve 19 is in a turn-off status when receiving balls and in a turn-on status when sending balls. The middle of the automatic rubber ball receiving-and-sending control valve 5 is in communication with the duckbill-shaped rubber ball receiving-and-sending waterway 32 through the main waterway 35. When the balls are being received, water can flow into the duckbill-shaped rubber ball receiving-and-sending waterway 32 through the flow channel holes of the tapered filter screen, and the rubber balls are kept inside the rubber ball collection cavity 6. Lower left and right sides of the rubber ball collection cavity 6 are respectively in communication with the first division drainage tube 20 and the second division drainage tube 21. Both ends of the rubber ball collection cavity 6 are welded shut with a blind flange and integrally welded to the divider 23. In this embodiment, the rubber ball division separator 24 is disposed inside the lower water box 31, and the division separator 24 extends to the ball strainer 36, so as to divide the lower water box 31 into two independent ball sending regions. At the same time, a rear end division separator 37 is correspondingly disposed inside the rear end. Referring to FIG. 35, in this embodiment, the division separator 24 is a stainless steel plate or other corrosion resistant materials punched with holes, with an aperture of Φ6 (that is, the diameter of the holes is 6 mm, the diameter of the holes is set according to the size of the rubber balls, and the diameter of the holes is smaller than the diameter of the rubber balls). The division separator 24 is placed in the middle and rear end of the lower water box 31, and serves a ball sending division function together with the rear end division separator 37 inside the rear end. Thus, the rubber balls 10 only clean half of the condenser heat exchange tube 9 each time, so as to realize a better cleaning effect. Referring to FIGS. 29 to 34, the rubber ball collection cavity 6 and the cooling water outlet pipe 4 are in communication with each other through the first division drainage tube 20 and the second division drainage tube 21. One end of the first division drainage tube 20 is in communication with the rubber ball collection cavity 6 after passing through the water box 2. A filter screen is disposed at the end of the first division drainage tube 20 inside the rubber ball collection cavity 6 to block the rubber balls 10, so as to prevent the rubber balls 10 from entering the cooling water outlet pipe 4. The other end of the first division drainage tube 20 is in communication with the cooling water outlet pipe 4. The first drainage control electromagnetic valve 16 is installed on the first division drainage tube 20. In a similar structure, one end of the second division drainage tube 21 is in communication with the rubber ball collection cavity 6, and the other end is in communication with the cooling water outlet pipe 4. The second drainage control electromagnetic valve 17 is installed on the second division drainage tube 21. Normally, the first drainage control electromagnetic valve 16 and the second drainage control electromagnetic valve 17 are in a turn-off status, and during division drainage, the first drainage control electromagnetic valve 16 is turned on, and the rubber balls 10 inside the rubber ball collection cavity 6 gather at a position close to the first drainage control electromagnetic valve 16 with the division drainage water flow. Similarly, in the next cleaning process, the second drainage control electromagnetic valve 17 is turned on, and the rubber balls 10 inside the rubber ball collection cavity 6 gather at a position close to the second drainage control electromagnetic valve 17 with the drainage water flow. Thus, the division drainage function is achieved. Referring to FIGS. 21 to 23, 33 and 34, one end of the rubber ball collection cavity 6 is in communication with the ball observer 11 through the short tube 33. The manual ball valve 12 is disposed on the short tube 33. The manual high pressure ball valve 14 is installed between the ball observer 11 and the lower water box 31. The drain valve 15 is installed at the bottom of the ball observer 11. A ball observer exhaust port 38 is disposed at the upper portion of the ball observer 11, so as to exhaust the air inside the ball observer. A sight glass 18 is installed at a central position of the ball observer 11. After the present invention operates for a period of time, the rubber balls 10 can be examined or replaced through the ball observer 11. The rubber balls 10 gather inside the rubber ball collection cavity 6, the ball receiving main check valve 27 and the bottom check valve 25 of the ball receiving tube segment are in a turn-on status, and the ball sending control valve 19 and the ball sending check valve 22 as well as the first drainage control electromagnetic valve 16 and the second drainage control electromagnetic valve 17 are in a turn-off status. The manual ball valve 12 and ball observer drain valve 15 are manually turned on, and the rubber balls 10 inside the rubber ball collection cavity 6 flow into the ball observer 11 with the water flow. The manual ball valve 12 and the ball observer drain valve 15 are manually turned off, so the rubber balls 10 are cut off from the cooling water system of the condenser, and the appearance and abrasion situation of the rubber balls 10 can be observed through the sight glass 18. At the same time, the sight glass 18 can be opened to replace the rubber balls 10. After the ball observation or the rubber ball replacement, the manual ball valve 12 and the manual high pressure ball valve 15 are manually turned on, the high pressure water inside the system pushes the rubber balls 10 into the rubber ball collection cavity 6, and then the manual high pressure ball valve 14 is turned off.

In the present invention, a programmable controller is used as an automatic rubber ball cleaning controller, so as to control automatic rubber ball cleaning. Referring to FIGS. 24 to 28, the automatic rubber ball cleaning controller is installed inside the control box 13, and the integral control box 13 is fixed outside the front end water box 2. The protection grade of the control box 13 is IP23. A programmable controller is disposed inside the control box 13, which is a main control chip. A display and operation buttons are disposed on the control box 13. The display is an LCD display. A power indicator, a standby indicator, a ball sending main control valve indicator, a first division drainage control electromagnetic valve work indicator, a second division drainage control electromagnetic valve work indicator, and a system stop/failure indicator are installed on the control box 13 at the same time to display the work status of the present invention. At the same time, an operation panel is disposed outside the control box, and input buttons are disposed on the operation panel. The input buttons include a parameter setup key, a manual start composite key, a parameter setting confirmation and manual stop composite key, so as to set operation parameters for the system. When the present invention is in a standby status, the main control valve and two division drainage control electromagnetic valves are all turned off. When the automatic control box 13 receives a passive signal of startup from a host computer, 15 minutes is delayed (the time is adjustable), the first division drainage control electromagnetic valve is turned on; 1 minute (the time is adjustable) later, the first division drainage control electromagnetic valve is turned off, and the main control valve is turned on; 1 minute (the time is adjustable) later, the main control valve is turned off, and the second division drainage control electromagnetic valve is turned on; 1 minute (the time is adjustable) later, the second division drainage control electromagnetic valve is turned off, and the main control valve is turned on; and 1 minute (the time is adjustable) later, the main control valve is turned off, so that one division cleaning process is completed. According to a preset program, the above operations are repeated every 3 minutes (the time is adjustable) for five times (adjustable), and the division cleaning process is performed for six times (adjustable), which is regarded as a cleaning period. After six hours (the time is adjustable), the above operations are automatically repeated according to the preset program (the built-in program automatically computes practical startup operation time of the chiller), so as to realize automatic on-line cleaning. The cleaning operations can be manually performed on site through the operation buttons. Through the operation buttons, the practical cleaning times are displayed on the main display. The present invention can also achieve communication with the chiller and the host computer through the provided MODBUS Protocol and RS-485 interface, so as to display work statuses such as standby, operation, cleaning times, and failure.

Figure 36:
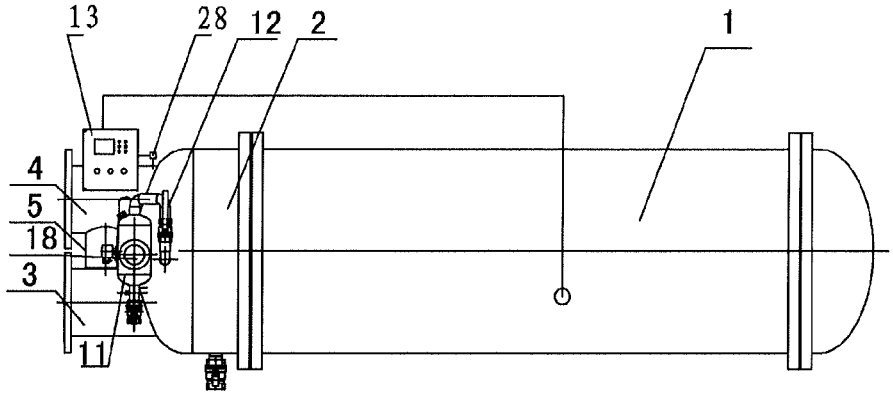
FIG. 36 is a schematic structural view of a TTD monitoring and recording system according to the present invention.
Figure 37:
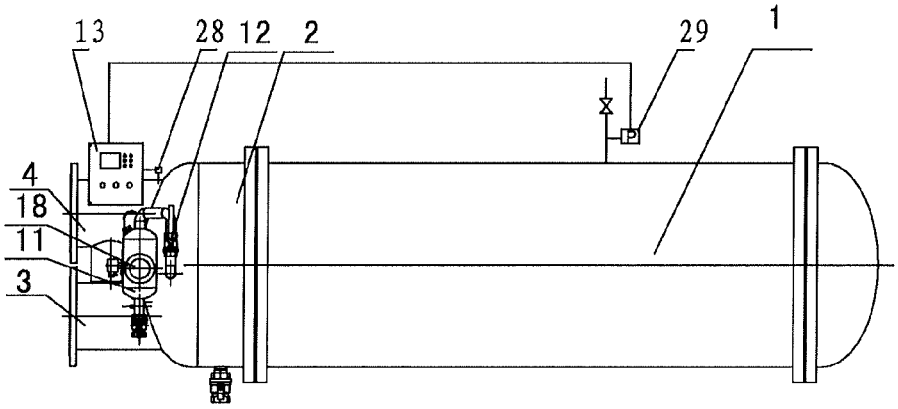
FIG. 37 is a schematic structural view of a TTD monitoring and recording system according to the present invention.

The present invention further has a TTD monitoring and recording function. The TTD monitoring and recording function is implemented by adopting a temperature display and record module in combination with a sensor, which is composed of common data collection, comparison, recording, and transmission functions. Referring to FIGS. 35 to 37, the temperature display and record module uses a micro controller as the TTD monitoring and recording chip, which forms a hardware system of the TTD monitoring and recording system in combination with two sensors. The TTD display and record chip are embedded inside the automatic control box 13. The temperature sensor 28 is disposed at the cooling water outlet pipe 4. The temperature sensor 28 is installed on the cooling water outlet pipe 4. The condensing temperature of the refrigerant can be measured through two types of sensors. One type is a pressure sensor 29 installed on the condenser body 1, which is used to measure a condensing pressure of the refrigerant, and convert the condensing pressure into temperature data through a program preset in the chip (a general approach in the prior art). The other type is a temperature sensor installed at an outer wall of the condenser, which directly measures the condensing temperature of the refrigerant. By pressing the button, the TTD can be displayed on the LCD display of the automatic control box 13. The TTD recording program is preset inside the chip and the TTD can be automatically recorded every two hours (the time is adjustable). The history of TTD records can be downloaded through the USB interface for the TTD recording, and a history of TTD diagram is automatically generated by special software. One general power inlet and three control valve power ports as well as a wire interface of the temperature sensor are disposed on the control box, and also an RS-485 interface for communication with a host computer and a USB interface for exporting TTD records on site are disposed thereon. Each interface is respectively connected to the TTD display and record chip.

Figure 3:
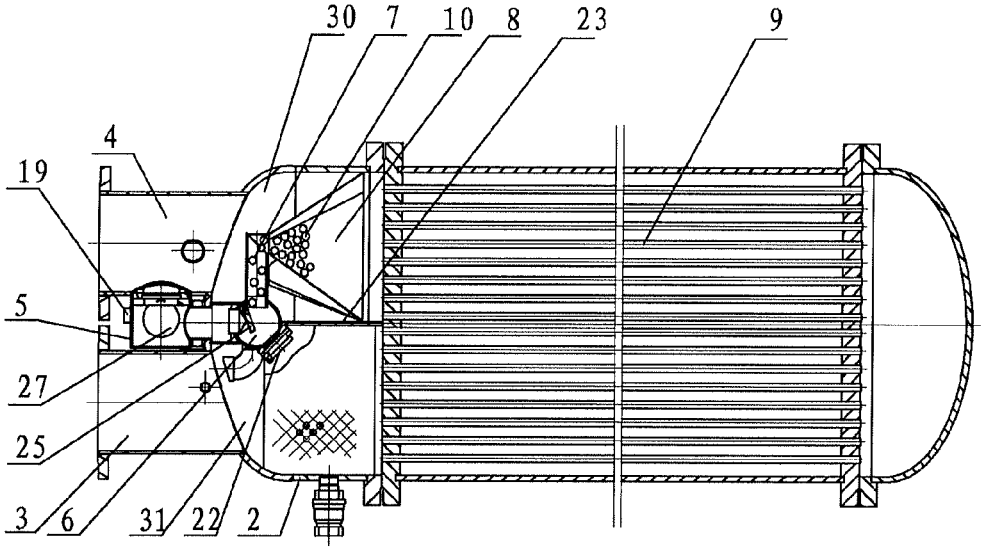
FIG. 3 is a schematic structural inner view (in a rubber ball collection status) according to the present invention.
Figure 4:
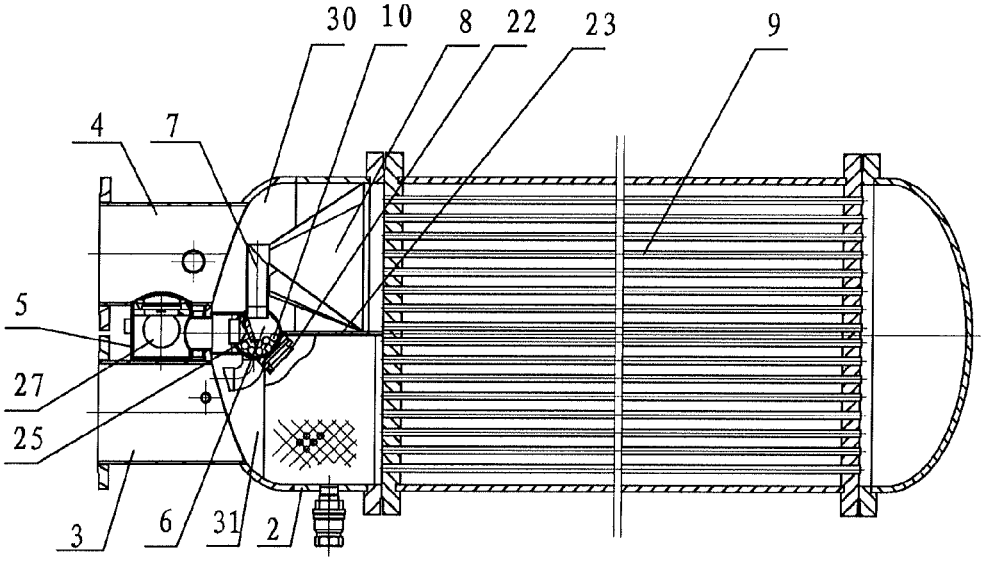
FIG. 4 is a schematic structural inner view (in a rubber ball collection and division drainage status) according to the present invention.

When the present invention is running, referring to FIG. 3, which is a schematic structural view in a rubber ball collection status according to the present invention, the ball receiving main check valve 27 and the bottom check valve 25 of the ball receiving tube segment 7 are in a turn-on status, and the ball sending control valve 19 and the ball sending check valve 22 are in a turn-off status. At this time, the cooling water carries the rubber balls 10 into the upper water box 30 of the front end water box. After being filtered by the ball receiving filter screen 8, the cooling water flows out of the cooling water outlet pipe 4. At this time, the rubber balls 10 gather at the ball receiving tube segment 7. Referring to FIG. 4, the rubber balls 10 enter the rubber ball collection cavity 6 with the ball receiving drainage water, and the ball receiving process is finished. Referring to FIGS. 5 and 6, which are schematic structural views in a rubber ball sending status according to the present invention, the automatic control program turns on the ball sending control valve 19, the high pressure water enters the ball sending control valve 19, the ball receiving main check valve 27 is turned off, the high pressure water flow flows into the rubber ball collection cavity 6, and after turning off the bottom check valve 25 of the ball receiving tube segment, the high pressure water flow flushes on the ball sending check valve 22, at the same time the rubber balls 10 are sent into the lower water box 31, and the rubber balls 10 can only enter half of the condensing heat exchange tube 9 with the cooling water due to the blockage of the rubber ball division separator 24 of the front end water box, so the division ball sending process is finished. The rubber balls 10 flow inside the heat exchange tube 9 in the condenser of the chiller with the cooling water depending on the water pressure difference, remove the dirt on the inner wall of the heat exchange tube through friction with the inner wall of the condenser heat exchange tube 9, and flow back into the upper water box 30 with the cooling water, so a cleaning process is finished. This process is repeated, so as to achieve an automatic on-line division cleaning process.

What is claimed is:

1. A front end water box with an on-line rubber ball cleaning function in a tubular condenser of a water cooled chiller, wherein the front end water box is divided into an upper water box and a lower water box by a divider in the middle, the upper water box is in communication with the outlet of a condenser heat exchange tube, the upper water box is in communication with the cooling water outlet pipe, the upper water box being located inside an outlet manifold of the condenser, the lower water box is in communication with the inlet of the condenser heat exchange tube, the lower water box is in communication with the cooling water inlet pipe, the lower water box being located inside an inlet manifold of the condenser, an automatic on-line rubber ball cleaning device is disposed inside the front end water box, the automatic on-line rubber ball cleaning device and front end water box are integrally disposed, the automatic on-line rubber ball cleaning device comprises a ball receiving device, a rubber ball collection cavity, a ball sending device and an automatic rubber ball receiving-and-sending control valve, the ball receiving device is disposed inside the upper water box and used for receiving rubber balls, the ball receiving device is in communication with the rubber ball collection cavity, the rubber ball collection cavity is in communication with the ball sending device, the ball sending device is in communication with the lower water box and used for sending the rubber balls into the lower water box, the water inlet end of the automatic rubber ball receiving-and-sending control valve is in communication with the cooling water inlet pipe, the water outlet end of the automatic rubber ball receiving-and-sending control valve is in communication with the cooling water outlet pipe, a connecting end of the automatic rubber ball receiving-and-sending control valve is in communication with the rubber ball collection cavity, an automatic rubber ball cleaning controller located outside of the front end water box, and wherein the automatic rubber ball cleaning controller controls the automatic rubber ball receiving-and-sending control valve.

2. The front end water box with an on-line rubber ball cleaning function in a tubular condenser of a water cooled chiller according to claim 1, wherein the ball receiving device comprises a bottom check valve and one or more ball receiving filter screen disposed inside the upper water box, the ball receiving filter screen has a special horn shape, the opening of the horn-shaped ball receiving filter screen faces the outlet of the condenser heat exchange tube, openings of the ball receiving filter screens are joined to match the cross-sectional shape of the upper water box, tail ends of the ball receiving filter screens are in communication with the rubber ball collection cavity through tube segments, and the bottom check valve is fixedly installed at the end of the tube segment at the rubber ball collection cavity.

3. The front end water box with an on-line rubber ball cleaning function in a tubular condenser of a water cooled chiller according to claim 2, wherein the rubber ball collection cavity is fixedly connected to the top of the front end water box, a duckbill-shaped rubber ball receiving-and-sending water way is provided at a connecting position between the rubber ball collection cavity and the top of the front end water box, circular holes are opened at the top of the front end water box, and the duckbill-shaped rubber ball receiving-and-sending water way is in communication with an connecting end of the automatic rubber ball receiving-and-sending control valve at the circular holes of the top of the front end water box.

4. The front end water box with an on-line rubber ball cleaning function in a tubular condenser of a water cooled chiller according to claim 3, wherein one or more circular holes are opened at a side wall of the rubber ball collection cavity, a tapered filter screen is installed at the end of each circular hole inside the rubber ball collection cavity, each tapered filter screen urges a bottom check valve, and the other end of the circular hole is in communication with the duckbill-shaped rubber ball receiving-and-sending water way.

5. The front end water box with an on-line rubber ball cleaning function in a tubular condenser of a water cooled chiller according to claim 1, wherein the outlet of the rubber ball collection cavity is in communication with the lower water box, and a ball sending check valve is disposed between the rubber ball collection cavity and the lower water box.

6. The front end water box with an on-line rubber ball cleaning function in a tubular condenser of a water cooled chiller according to claim 3, wherein one or more rubber ball division separators are fixedly installed inside the lower water box to separate the lower water box into two or more ball sending regions, a ball sending check valve is installed between the rubber ball collection cavity and each ball sending region, and the direction of the rubber ball division separator is the downstream direction of cooling water inside the lower water box.

7. The front end water box with an on-line rubber ball cleaning function in a tubular condenser of a water cooled chiller according to claim 4, wherein a vertical rubber ball division separator is fixedly installed inside the lower water box to separate the lower water box into left and right ball sending regions, left and right sides of the rubber ball collection cavity are respectively in communication with the cooling water outlet pipe through a first division drainage tube and a second division drainage tube, one end of the first division drainage tube extends into the rubber ball collection cavity, a tapered filter screen is fixedly installed at the end inside the rubber ball collection cavity, the other end of the first division drainage tube is in communication with the cooling water outlet pipe, a first drainage control electromagnetic valve is installed in the middle of the first division drainage tube, an end of the second division drainage tube extends into the rubber ball collection cavity, a tapered filter screen is fixedly installed at the end inside the rubber ball collection cavity, the other end of the second division drainage tube is in communication with the cooling water outlet pipe, and a second drainage control electromagnetic valve is installed in the middle of the second division drainage tube.

8. The front end water box with an on-line rubber ball cleaning function in a tubular condenser of a water cooled chiller according to claim 4, wherein the rubber ball division separator is made of a corrosion resistant material, and holes smaller than the diameter of the rubber balls are punched on the rubber ball division separator.

9. The front end water box with an on-line rubber ball cleaning function in a tubular condenser of a water cooled chiller according to claim 1, wherein a ball observer is fixedly installed at an outer side of said water box, a transparent ball observation sight glass is disposed at a central position of the ball observer, the inlet of the ball observer is in communication with the rubber ball collection cavity through a tube segment, a manual ball valve is disposed on the tube segment at the inlet of the ball observer, the outlet of the ball observer is in communication with the cooling water inlet pipe through a tube segment, a manual high pressure ball valve is disposed between the outlet of the ball observer and the cooling water inlet pipe, and a drain valve is disposed at the bottom of the ball observer.

10. The front end water box with an on-line rubber ball cleaning function in a tubular condenser of a water cooled chiller according to claim 1, wherein a control box is fixedly installed at an outer side of the front end water box, the automatic rubber ball cleaning controller is installed inside the control box, the automatic rubber ball cleaning controller comprises a programmable controller, a display, and input buttons, and the display and the input buttons are respectively connected to a data port of the programmable controller, a temperature display and record module is further disposed inside the control box, two temperature sensors are connected to the temperature display and record module, one temperature sensor is disposed at the cooling water outlet pipe, and the other temperature sensor is disposed on the condenser body, or the temperature display and record module is respectively connected to a temperature sensor and a pressure sensor, the temperature sensor is disposed at the cooling water outlet pipe, and the pressure sensor is disposed on the condenser body.

* * * * *